US005315566A

United States Patent [19]

Stein

[11] Patent Number: 5,315,566

[45] Date of Patent: May 24, 1994

[54] TIME SCALE COMPUTATION SYSTEM

[75] Inventor: Samuel R. Stein, Boulder, Colo.

[73] Assignee: Timing Solutions Corporation, Boulder, Colo.

[21] Appl. No.: 80,970

[22] Filed: Jun. 22, 1993

[51] Int. Cl.[5] ..... G04C 11/00; G04F 5/00

[52] U.S. Cl. ..... 368/46; 368/156; 364/569

[58] Field of Search ..... 368/10, 46, 47, 52, 368/59, 155-156, 200-202; 364/569

[56] References Cited

U.S. PATENT DOCUMENTS

| | | | |
|---|---|---|---|
| 4,809,005 | 2/1989 | Counselman | 342/352 |
| 4,866,606 | 9/1989 | Kopetz | 364/200 |
| 4,899,117 | 2/1990 | Vig | 331/3 |
| 5,155,695 | 10/1992 | Stein | 364/569 |

OTHER PUBLICATIONS

Allan, et al., "Time and Frequency: Theory and Fundamentals", NBS Monograph 140, Chapter 9, pp. 205-231, U.S. Department of Commerce/National Bureau of Standards, 1973.

Richard N. Jones and Peter V. Tryon, "Estimating Time from Atomic Clocks", Journal of Research of the National Bureau of Standards, vol. 88, No. 1, pp. 17-24, Jan.-Feb. 1983.

*Primary Examiner*—Vit W. Miska

*Attorney, Agent, or Firm*—Sheridan Ross & McIntosh

[57] ABSTRACT

An improved system for providing ensemble time from an ensemble of oscillators is provided. The improved system provides an ensemble time definition whose large number of possible solutions for an ensemble time are constrained to a limited number of solutions. In one embodiment, a substantially infinite number of solutions is constrained to a single solution.

8 Claims, 1 Drawing Sheet

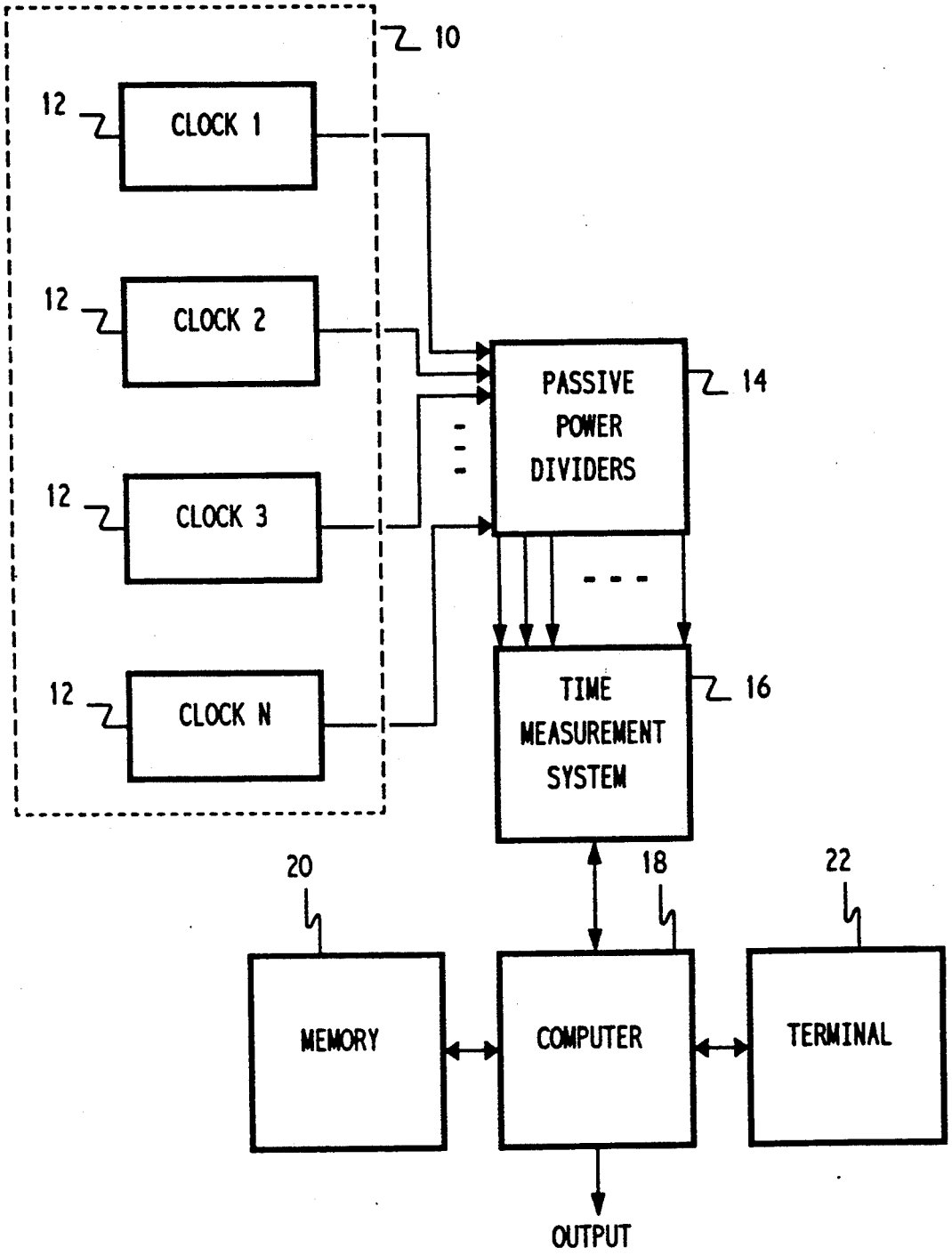
10
12
CLOCK 1
12
CLOCK 2
12
CLOCK 3
12
CLOCK N
PASSIVE POWER DIVIDERS
14
TIME MEASUREMENT SYSTEM
16
20
18
22
MEMORY
COMPUTER
TERMINAL
OUTPUT

TIME SCALE COMPUTATION SYSTEM

BACKGROUND OF THE INVENTION

1. Field of the Invention

The present invention relates to the system employed and circuitry used with an ensemble of clocks to obtain an ensemble time. More particularly, the present invention relates to an improved algorithm defining ensemble time that can be, for example, implemented with Kalman filters for obtaining an improved estimate of time from an ensemble of clocks.

2. Description of the Related Art

For a number of years, groups of precision clocks used in combination have provided the "time" in situations in which high precision timekeeping is required. For example, an "official" time for the United States is provided by the atomic time scale at the National Bureau of Standards, the UTC(NBS), which depends upon an ensemble of continuously operating cesium clocks. The time interval known as the "second" has been defined in terms of the cesium atom by the General Conference of Weights and Measures to be the duration of 9,192,631,770 periods of the radiation corresponding to the transition between the two hyperfine levels of the ground state of the cesium-133 atom. Other clocks may be calibrated according to this definition. Thus, while each clock in a group or ensemble of clocks is typically some type of atomic clock, each clock need not be a cesium clock.

Even though one such atomic clock alone is theoretically quite accurate, in many applications demanding high accuracy it is preferred that an ensemble of atomic clocks be used to keep time for a number of reasons. Typically, no two identical clocks will keep precisely the identical time. This is due to a number of factors, including differing frequencies, noise, frequency aging, etc. Further, such clocks are not 100% reliable; that is, they are subject to failure. Accordingly, by using an ensemble of clocks in combination, a more precise estimate of the time can be maintained.

When an ensemble of clocks is utilized to provide an estimate of time, various techniques may be employed for processing the signals output by the clocks to obtain the "time". Typically, interclock time comparisons are made to determine the relative time and frequency of each clock. The noise spectrum of each clock is represented by a mathematical model, with noise parameters determined by the behavior of the individual clock. Clock readings are combined based on these comparisons and models to produce the time scale.

A problem with known systems for providing an estimate of time or a time scale based upon an ensemble of clocks is that the individual states of the clocks are not observable and only clock differences can be measured. As a result, there are an infinite number of solutions or estimates of time possible. Stated another way, the systems are underdetermined. For example, in systems that implement a Kalman filter approach to estimating time, the lack of observability and resultant underdetermined character of the system manifest themselves in covariance matrix elements that grow on each cycle of the Kalman recursion. Since the computation is implemented on a computer system with finite accuracy, this growth eventually causes computational problems. In addition to reducing the consequences of lack of observabililty, it is also desirable to obtain a substantially unbiased estimate of clock performance that can be used to achieve a ensemble time system that is adaptive. Moreover, there is a need to achieve this adaptive quality while also maintaining or improving the robustness of the resulting ensemble time.

There is yet a further need for an ensemble time system that permits estimates of all of the spectral densities of the clocks in the system, detects steps in state estimates, and provides improved performance over a wider range of averaging times.

Based on the foregoing, there is a need for a system for estimating time based on a clock ensemble that addresses the aforementioned needs.

SUMMARY OF THE INVENTION

Accordingly, one object of the present invention is to address the consequences of the lack of observability of individual clock states in an ensemble clock system and, in particular, the plurality of solutions to the ensemble time definition, or, stated differently, the underdetermined character of such systems.

To achieve this objective, an ensemble time system is provided that includes a plurality or ensemble of clocks, a mechanism for measuring differences in time related parameters between pairs of clocks, and a device for providing an ensemble time that uses the differences and an ensemble time definition with a constrained number of solutions for the ensemble time. By providing a mechanism to constrain the number of solutions, an improved ensemble time is realized. Further, in systems that implement the ensemble time definition with Kalman filters, the constraining mechanism reduces computational problems associated with the covariance matrix.

An ensemble time system is also provided that provides a substantially unbiased estimate of the state of each clock in the system thereby permiting the system to be adaptive. In one embodiment, the estimates of the state of each clock is weighted in a fashion that is proportional to the rms noise of the state of the clock. In another embodiment, the ensemble time (in contrast to the estimates of the states) is also weighted but with a different set of weights than the state estimates, to achieve robustness and other desirable characteristics in the system.

In yet a further embodiment, a first ensemble time with a first sampling interval that provides substantially optimal performance is combined with a second ensemble time with a second sampling interval that has substantially optimal performance over a second range to provide a third ensemble time that has optimal performance over a greater range than either the first or second ensemble time. In this way, estimates of the spectral densities of all the clocks can be obtained, steps in the states being estimated can be detected, and improved performance over a wider range of averaging times obtained. In one embodiment, a phase-locked loop is used to combine the first and second ensemble times to obtain the third ensemble time.

Other objects and advantages of the present invention will be set forth in part in the description and drawing figure which follow, and will further be apparent to those skilled in the art.

BRIEF DESCRIPTION OF THE DRAWING

FIG. 1 is a circuit diagram of an implementation of the present invention.

DETAILED DESCRIPTION OF THE INVENTION

As discussed previously, one method for processing the output of a plurality of clocks (i.e., oscillators) included in an ensemble is referred to as the Kalman approach. In this Kalman approach, one of the clocks in the ensemble is temporarily designated as the reference clock, with the remaining clocks "aiding" the time provided by the reference clock. Kalman filters provide state estimation and forecasting functions. Generally, Kalman filters are used to model the performance of quartz oscillators and atomic clocks. Kalman filters act as minimum square error state estimators and are applicable to dynamic systems, that is, systems whose state evolves in time. Kalman filters are recursive and therefore have modest data storage requirements. When employed to provide time from an ensemble of clocks, Kalman filters can, of course, only provide estimates that reflect the algorithms which they embody.

The novel clock model utilized in the present invention takes into account the time, the frequency, and the frequency aging. The general form of the clock model consists of a series of integrations. The frequency aging is the integral of white noise, and therefore exhibits a random walk. The frequency is the integral of the frequency aging and an added white noise term, allowing for the existence of random walk frequency noise. The time is the integral of the frequency and an added white noise term which produces random walk phase noise, usually called white frequency noise. An unintegrated additive white noise on the phase state produces additive white phase noise.

When two clocks are compared, the relative states are the differences between the state vectors of the individual clocks. Hereinbelow, the state vector of a clock i will be referred to as $\vec{x}_i$. Only the differences between clocks can be measured. In terms of the state vectors, the differences between a clock j and a clock k at time t is denoted by $$\vec{X}_{jk}(t)=\vec{X}_j(t)-\vec{X}_k(t)$$

The same approach will be used below to denote the time of a clock with respect to an ensemble. The ensemble is designated by the subscript e. Since ensemble time is a computed quantity, the ensemble is only realizable in terms of its difference from a physical clock.

In the present invention, the individual clock state vector is four-dimensional. In prior approaches, the comparable state vector has more typically been a two-dimensional state vector, taking into account only a phase component and a frequency component. In contrast, the present invention utilizes a system model which incorporates the time, the time without white phase noise, the frequency, and the frequency aging into a four-dimensional state vector, such that a four-dimensional state vector $\vec{x}_{jk}(t)$ is as follows:

$$\vec{x}_{jk}(t)=\begin{bmatrix} u(t) \\ x(t) \\ y(t) \\ w(t) \end{bmatrix} \tag{1}$$

where u(t) is the time of the system (in this case a clock pair) at sample (t), x(t) is the time of the system without white phase noise at sample (t), y(t) is the frequency of the system at sample (t), and w(t) is the frequency aging of the system at sample (t). The state vector evolves from time t to time t+δ according to $$\vec{X}_{jk}(t+\delta)=\Phi(\delta)\vec{X}_{jk}(t)+\Gamma\vec{s}_{jk}(t+\delta|t)+\Phi(\delta)\vec{p}_{jk}(t) \tag{2}$$

where $\Phi(\delta)$ is a 4×4 dimensional state transition matrix, $\Gamma\vec{s}_{jk}$ is the plant noise and $\Gamma\vec{s}_{jk}(t+\delta|t)$ is a four-dimensional vector containing the noise inputs to the system during the time interval from t to t+δ, and $\vec{p}_{jk}(t)$ is a four-dimensional vector containing the control inputs made at time t.

The 4×4 dimensional state transition matrix $\Phi(\delta)$ embodies the system model described above. The state transition matrix is assumed to depend on the length of the interval, but not on the origin, such that $$\Phi(\delta)=\begin{bmatrix} 0 & 1 & \delta & \delta^2/2 \\ 0 & 1 & \delta & \delta^2/2 \\ 0 & 0 & 1 & \delta \\ 0 & 0 & 0 & 1 \end{bmatrix}. \tag{3}$$

The four-dimensional vector $\Gamma(\delta)\vec{s}_{jk}(t+\delta|t)$ contains the noise input to the system during the interval from t to t+δ, where $$\vec{s}_{jk}(t+\delta|t)=\begin{bmatrix} \beta'_{jk}(t+\delta) \\ \epsilon'_{jk}(t+\delta|t) \\ \eta'_{jk}(t+\delta|t) \\ \alpha'_{jk}(t+\delta|t) \end{bmatrix} \text{ and} \tag{4}$$

$$\Gamma(\delta)=\begin{bmatrix} 1 & 1 & 0 & 0 \\ 0 & 1 & 0 & 0 \\ 0 & 0 & 1 & 0 \\ 0 & 0 & 0 & 1 \end{bmatrix}, \tag{5}$$

and where $\beta'_{jk}(t+\delta)$ is the white time noise input between clocks j and k at time (t+δ), $\epsilon'_{jk}(t+\epsilon|t)$ is the white frequency noise input at time t+δ, $\eta'_{jk}(t+\delta|t)$ is the random walk frequency noise input at time t+δ, and $\alpha_{jk}(t+67\ |t)$ is the random walk frequency aging noise input at time t+δ. Each element of $\vec{s}(t+\delta|t)$ is normally distributed with zero mean and is uncorrelated in time. The four-dimensional vector $\vec{p}(t)$ contains the control input made at time t.

Equation 2 generates a random walk in the elements of the state vector.

A single observation z(t) can be described by a measurement equation. Such an equation relative to clocks j and k can take the following form:

$$Z_{jk}(t)=H(t)\vec{X}_{jk}(t)+v_{jk}(t) \tag{6}$$

where H(t) is a 1×4 dimensional measurement matrix and v(t) is the scalar white noise. An observation made at time t is linear-related to the four elements of the state vector (Equation 1) by the 1×4 dimensional measurement matrix H(t) and the scalar white noise v(t).

The noise covariance matrix of the measurement noise, R(t), is defined as follows:

$$R(t)=E[\vec{V}_{jk}(t)\vec{V}_{jk}(t)^T] \tag{7}$$

where E[] is an expectation operator and $\vec{v}_{jk}(t)^T$ is the transpose of the noise vector.

Phase measurements of the clock relative to the reference are described by $$H(t)=(1000)\text{and } R=\sigma^2_{vzjk}. \tag{8}$$

where $\sigma^2_{vxjk}$ is the variance of the phase measurement process.

Similarly, the frequency measurements are described by $$H(t)=(0010) \text{ and } R=\sigma^2_{vyjk}. \tag{9}$$

$Q^{jk}(t+\delta|t)$ is the covariance matrix of the system (or plant) noise generated during an interval from t to $t+\delta$, and is defined by $$Q^{jk}(t+\delta|t)=E[\vec{S}_{jk}(T+\delta|t)\vec{S}_{jk}(t+\delta|t)^T] \tag{10}$$

The system covariance matrix can be expressed in terms of the spectral densities of the noises such that $$Q^{jk}(t+\delta|t)=\begin{bmatrix} S^{jk}_{\beta'}(t)f_h & 0 & 0 & 0 \\ 0 & S^{jk}_{\xi}(t)\delta+S^{jk}_{\mu}(t)\delta^3/3+S^{jk}_{\zeta}(t)\delta^5/20 & S^{jk}_{\mu}(t)\delta^2/2+S^{jk}_{\zeta}(t)\delta^4/8 & S^{jk}_{\zeta}(t)\delta^3/6 \\ 0 & S^{jk}_{\mu}(t)\delta^2/2+S^{jk}_{\zeta}(t)\delta^4/8 & S^{jk}_{\mu}(t)\delta+S^{jk}_{\zeta}(t)\delta^3/3 & S^{jk}_{\zeta}(t)\delta^2/2 \\ 0 & S^{jk}_{\zeta}(t)\delta^3/6 & S^{jk}_{\zeta}(t)\delta^2/2 & S^{jk}_{\zeta}(t)\delta \end{bmatrix} \tag{11}$$

where $f_h$ is an infinitely sharp high-frequency cutoff. Without this bandwidth limitation, the variance of the white phase additive noise would be infinite. The clock pair spectral densities are the sum of the individual contributions from each of the clocks, $$S^{jk}=S^j+S^k \tag{12}$$

where $S^j$ and $S^k$ are the spectral densities of clocks j and k, respectively. An alternative way to write the elements of the plant co variance matrix for a clock pair jk is $$E[\beta'_{jk}(t+\delta)\beta'_{jk}(t+\delta)]=S_{\beta}^{jk}(t)f_h \tag{13}$$

$$E[\epsilon'_{jk}(t+\delta|t)\xi'_{jk}(t+\delta|t)]=S_{68}^{jk}(t)\delta+S_{\mu}^{jk}(t)\delta^3/3+S_{\zeta}^{jk}(t)\delta^5/20 \tag{14}$$

$$E[\eta'_{jk}(t+\delta|t)\eta'_{jk}(t+\delta|t)=S_{\mu}^{jk}(t)\delta+S_{\zeta}^{jk}(t)\delta^3/3 \tag{15}$$

$$E[\alpha'_{jk}(t+\delta|t)\alpha'_{jk}(t+\delta|t)]=S_{\zeta}^{jk}(t)\delta \tag{16}$$

$$E[\beta'_{jk}(t+\delta|t)\epsilon'_{jk}(t+\delta|t)]=0 \tag{17}$$

$$E[\beta'_{jk}(t+\delta|t)\eta'_{jk}(t+\delta|t)]=0 \tag{18}$$

$$E[\beta'_{jk}(t+\delta|t)\alpha'_{jk}(t+\delta|t)]=0 \tag{19}$$

$$E[\epsilon'_{jk}(t+\delta|t)\eta'_{jk}(t+\delta|t)]=S_{\mu}^{jk}(t)\delta^2/2+S_{\zeta}^{jk}(t)\delta^4/ \tag{20}$$

$$E[\epsilon'_{jk}(t+\delta|t)\alpha'_{jk}(t+\delta|t)]=S_{\zeta}^{k}(t)\delta^3/6 \tag{21}$$

$$E[\eta'_{jk}(t+\delta|t)\alpha'_{jk}(t+\delta|t)]=S_{\zeta}^{jk}(t)\delta^2/2 \tag{22}$$

The spectral density of a noise process is the noise power per Hz bandwidth. The integral of the spectral density is the variance of the process. Thus, for a two-sided spectral density of the noise process a, $$\sigma_a^2=\int_{-\infty}^{\infty} S_a(f)df.$$

It is this form of the plant covariance (i.e., Equations 13–22) which will be used to calculate the plant covariance of the reference clock versus the ensemble.

As discussed briefly above, one of the clocks in the ensemble is used as a reference and is designated as clock j. The choice of clock j as the reference clock is arbitrary and may be changed computationally. The role of the reference clock j is to provide initial estimates and to be the physical clock whose differences from the ensemble are calculated. Given that the ensemble consists of N clocks, each of the other N−1 clocks is used as an aiding source. That is, each of the remaining clocks provides an independent representation of the states of clock j with respect to the ensemble. As indicated, these states are time, frequency, and frequency aging. The present invention defines the states of each clock with respect to the ensemble to be the weighted average of these representations, and the present invention provides a user with full control over the weighting scheme. Given $\vec{x}(t_2|t_1)$ denotes a forecast of $\vec{x}$ at time $t_2$ based on the true state through time $t_1$, time, frequency, and frequency aging of a multiple weight ensemble can be defined as follows:

$$u_{je}(t+\delta)=\sum_{i=1}^{N} a_i(t)[u_{ie}(t+\delta|t)+u_{ji}(t+\delta)] \tag{23}$$

$$y_{je}(t+\delta)=\sum_{i=1}^{N} b_i(t)[y_{ie}(t+\delta|t)+y_{ji}(t+\delta)] \tag{24}$$

$$w_{je}(t+\delta)=\sum_{i=1}^{N} c_i(t)[w_{ie}(t+\delta|t)+w_{ji}(t+\delta)] \tag{25}$$

Each new time of a clock j with respect to the ensemble depends only on the prior states of all the clocks with respect to the ensemble and the current clock difference states. The ensemble definition uses the forecasts of the true states from time t to $t+\delta$, that is, $$\vec{x}(t+\delta|t)=\Phi(t+\delta|t)\vec{x}(t) \tag{26}$$

where $\vec{x}(t+\delta|t)$ is the forecasted state vector at time $(t+\delta)$ based on the true state through time t. No unsupported estimated quantities are involved in the definition.

Prior approaches have frequently used relations superficially similar to that found in Equation 23 to define ensemble time. However, as the present inventor has found, Equation 23 alone does not provide a complete definition of the ensemble time. Since the prior art does not provide a complete definition of the ensemble time, the filters employed in the prior art do not yield the best estimate of ensemble time. The present invention provides a more complete definition of ensemble time based not only on the time equation (Equation 23), but also on the frequency and frequency aging relations (Equations 24 and 25).

The time-scale is used to correct the time of its individual members. Thus the time of the time-scale is obtained from the relation $$u_e(t)=u_j(t)-u_{je}(t). \tag{26-1}$$

Since we can only estimate the time of a clock with respect to the time-scale, the computed correction is $$u_e^{corr}(t)=u_j(t)-\hat{u}_{je}(t|t)=\hat{u}_e(t|t)+[u_j(t)-\hat{u}_j(t|t)]. \tag{26-2}$$

Equation 26-2 means that we use the correction $\hat{u}_{je}(t|t)$ to the time of clock j in order to perform an action according to the time-scale. Thus if clock j is estimated to be 2 seconds fast compared to the time-scale, all actions that are synchronized to the time scale are performed when clock j reads 2 seconds after the designated time. The error in the correction $u_e^{corr}(t)$ relative to the true time-scale, $u_e(t)$, has two components-the error in the estimate of the ensemble and the error in the estimate of the clock j.

Equations 23, 24, and 25 are still not a unique definition because the individual clock states are not observable and only clock differences can be measured. Thus, an infinite number of solutions satisfy Equations 23, 24, and 25. For example, if $u_1, u_2, \ldots, u_n, u_e$ is a solution, then $u_1+p, u_2+p, \ldots, u_n+p, u_e+p$ is also a solution. What the clocks actually did is unknown and difference measurements cannot detect what truly happened. The correction term discussed above is not affected by the ambiguity of the individual clock and time-scale estimates since it involves their differences. However, the ambiguity produces practical problems. For example, when a Kalman filter is used to estimate the individual states, the covariance matrix elements grow on each cycle of the Kalman recursion since these states are not observable. The increasing size of the covariance matrix elements will eventually cause computational problems due to the finite accuracy of double precision math in a computer. The mixture of the two components of the covariance matrix elements may also cause problems with algorithms that use the covariance matrix elements to estimate the uncertainty of the state estimates. For example, the covariance matrix elements are used in parameter estimation and also to detect outlier observations before they are used in the state estimation process.

One way to eliminate the ambiguity that arises from the impossibility of making absolute time measurements is to introduce an independent relationship among the individual clock states that constrains the solution. To see how this might be done, we rewrite the ensemble definition in a different form:

$$u_e(t+\delta)-u_e(t+\delta|t)=\sum_{i=1}^{N} a_i(t)[u_i(t+\delta)-u_i(t+\delta|t)] \tag{26-3}$$

$$y_e(t+\delta)-y_e(t+\delta|t)=\sum_{i=1}^{N} b_i(t)[y_i(t+\delta)-y_i(t+\delta|t)] \tag{26-4}$$

-continued $$w_e(t+\delta)-w_e(t+\delta|t)=\sum_{i=1}^{N} c_i(t)[w_i(t+\delta)-w_i(t+\delta|t)] \tag{26-5}$$

We interpret these equations as follows. The difference between the true time-scale state at time $t+\delta$ and the forecast based on the true time-scale state at time t is the weighted mean of the differences between the true clock states at time $t+\delta$ and their forecasts based on the true clock states at time t. That is, the time-scale is the centroid of the individual clocks.

When the ensemble is composed of high quality atomic clocks, we believe a priori that the deviations of the clock times from a uniform time scale are random and uncorrelated. It is possible to force the estimates of the individual clock states to reflect this assumption. This is accomplished by introducing three constraint equations that select the solution with the desired properties:

$$\sum_{i=1}^{N} a'_i[u_i(t+\delta)-u_i(t+\delta|t)]=0 \tag{26-6}$$

$$\sum_{i=1}^{N} b'_i[y_i(t+\delta)-y_i(t+\delta|t)]=0 \tag{26-7}$$

$$\sum_{i=1}^{N} c'_i[w_i(t+\delta)-w_i(t+\delta|t)]=0 \tag{26-8}$$

The parameters $a'_i$, $b'_i$ and $c'_i$ may be chosen arbitrarily. However, the constraints have the undesirable effect of introducing correlation between the clocks. For example, in the case of two clocks, if one has a positive deviation the other must have a negative deviation. The resulting variances of the noise inputs are not equal to the true variances for arbitrary choices of the coefficients. To resolve this limitation, the coefficients $a'_i$, $b'_i$, and $c'_i$ are selected so that the noises on the estimated states of each clock are nearly equal to the true noises of that clock for all possible combinations of clocks with different levels of noise. We find that the coefficients are proportional to the rms noise on the clock states:

$$a'_k=\frac{1}{\sqrt{E[\beta'_k\beta'_k+E[\epsilon'_k\epsilon'_k]}}\left[\sum_{i=1}^{N}\frac{1}{\sqrt{E[\beta'_i\beta'_i]+E[\epsilon'_i\epsilon'_i]}}\right]^{-1} \tag{1a}$$

$$b'_k=\frac{1}{\sqrt{E[\eta'_k\eta'_k]}}\left[\sum_{i=1}^{N}\frac{1}{\sqrt{E[\eta'_i\eta'_i]}}\right]^{-1} \tag{1b}$$

$$c'_k=\frac{1}{\sqrt{E[\alpha'_k\alpha'_k]}}\left[\sum_{i=1}^{N}\frac{1}{\sqrt{E[\alpha'_i\alpha'_i]}}\right]^{-1} \tag{1c}$$

When these coefficients are used to scale the noise inputs to the clocks, the scaled noise all have unit variance. The constraint equations say that the sum of the unit variance noise inputs from all the ensemble members is zero. Heuristically, this seems very reasonable.

When the constraint equations are used one obtains estimates for the true states of each clock and an independent estimate of the time scale. The former are important in obtaining unbiased estimates of the spectral densities of the clocks. The latter permits the generation of system time using arbitrarily chosen weights. Separating the estimation of the truth from generation of the time scale increases flexibility and reduces biases.

The parameters $a_i$, $b_i$, and $c_i$ of equations 26-3 through 26-5 may be chosen arbitrarily. However, we note that when $a'_i=a$, $b'_i=b$, and $c'_i=c$, then the ensemble states are identically zero and the correction term for realizing the time-scale via a clock reduces to the time state of that clock. The constraining equations result in solutions for the clock states that are centered about zero and is a particular case of the time-scale definition. Using the constraint equations has a beneficial effect on the Kalman filter solution to the estimation problem. They relieve the nonobservability of the problem, and the covariance matrix approaches a finite asymptotic value. Such constraining equations are applicable to ensembles of other types of clocks than high quality atomic clocks. Further, comparable constraining equations can be applied to the ensemble time definition taught in the article by Richard H. Jones and Peter V. Tryon entitled "Estimating Time From Atomic Clocks", Journal of Research of the National Bureau of Standards, Vol. 88, No. 1, pp. 17–24, January-February 1983, incorporated herein by reference.

As noted above, $a_i(t)$, $b_i(t)$, and $c_i(t)$ represent weights to be chosen for each of the three relations described in Equations 23 through 25 for each of the N clocks in the ensemble. The weights may be chosen in any way subject to the restrictions that all of the weights are positive or 0 and the sum of the weights is 1. That is, $$\sum_{i=1}^{N} a_i(t) = \sum_{i=1}^{N} b_i(t) = \sum_{i=1}^{N} c_i(t) = 1 \tag{27}$$

The weights may be chosen to optimize the performance (e.g., by heavily weighting a higher quality clock relative to the others) and/or to minimize the risk of disturbance due to any single clock failure.

In contrast to the known prior approaches, the present invention provides a time scale algorithm that utilizes more than one weighting factor for each clock. Accordingly, the present invention is actually able to enhance performance at both short and long times even when the ensemble members have wildly different characteristics, such as cesium standards, active hydrogen masers and mercury ion frequency standards.

The use of multiple weights per clock improves the performance of the time scale compared to the use of a single weight per clock. However, it is possible to achieve additional performance improvements by combining independent time scales that are computed using different sampling rates. Let us consider heuristically why this would be so.

Suppose time scale A has a sampling interval of $\delta$ that is in the region where all the clocks are dominated by short-term noise such as white frequency noise. Further suppose that the clocks have widely varying levels of long-term noise such as random walk frequency. The apportionment of noise and the estimation of frequencies for time scale A is done based on time predictions over the short interval $\delta$ where the effects of the long-term noises are visible with a signal-to-noise ratio that is significantly less than 1.

Now suppose that time scale B has a sampling interval of $k\delta$, where k is large compared to 1, that is in the region where all of the clocks are dominated by the long-term random walk frequency noise. The apportionment of noise and the estimation of frequencies for time scale B is done based on the time predictions over the long interval $k\delta$ where the effects of the long-term noises are visible with a signal-to-noise ratio that is significantly greater than 1. This time scale will have more accurate apportionment of the long-term noises between the clocks because there will be no errors made in the apportionment of the short-term noise (an incorrect fraction of 0 is still 0).

Time scale A may be phase locked to time scale B to produce a single time scale with more nearly optimal performance over a wider range of sample times than the individual time scales. This method may be used to combine as many time scales as necessary. Each time scale is phase locked to the time scale with the next largest sampling interval. The time scale with the longest sampling interval is allowed to free run. A second order phase lock loop should be used to combine two time scales. This type of loop results in zero average closed loop time error between two time scales no matter how large the open loop frequency differences between the two scales.

Next, computational methods suitable for estimating the clocks states and the time scale are described. Through algebraic manipulations, the ensemble definition can be written in a form which is amenable to Kalman filter estimation. It can be shown that $$\vec{X}_{je}(t+\delta)=\Phi(\delta)\vec{x}_{je}(t)+\Gamma\vec{s}_{je}(t+\delta|t)-\Phi(\delta)\vec{p}_{je}(t) \tag{28}$$

where $$\beta_{je}(t+\delta|t) = \sum_{i=1}^{N} a_i(t)[\beta'_j(t+\delta|t) - \beta'_i(t+\delta|t)], \tag{29}$$

$$\epsilon'_{je}(t+\delta|t) = \sum_{i=1}^{N} a_i(t)[\epsilon'_j(t+\delta|t) - \epsilon'_i(t+\delta|t)], \tag{30}$$

$$\eta'_{je}(t+\delta|t) = \sum_{i=1}^{N} b_i(t)[\eta'_j(t+\delta|t) - \eta'_i(t+\delta|t)] \tag{31}$$

and $$\alpha'_{je}(t+\delta|t) = \sum_{i=1}^{N} c_i(t)[\alpha'_j(t+\delta|t) - \alpha'_i(t+\delta|t)], \tag{32}$$

where Equation 29 represents the additive white phase noise, Equation 30 represents the random walk phase, Equation 31 represents the random walk frequency, and Equation 32 represents the random walk frequency aging. This version of the ensemble definition is in the form required for the application Kalman filter techniques. As discussed above, the advantage of the Kalman approach is the inclusion of the system dynamics, which makes it possible to include a high degree of robustness and automation in the algorithm.

Next we describe two methods of using Kalman filters to estimate the times of the clocks with respect to the ensemble. The first method uses N separate Kalman filters to estimate the states of each of the N clocks.

Kalman Method 1: In order to apply Kalman filters to the problem of estimating the states of a clock obeying the state equations provided above, it is necessary to describe the observations in the form of Equation 6. This is accomplished by a transformation of coordinates on the raw clock time difference measurements or clock frequency difference measurements. Since z may denote either a time or a frequency observation, a pseudomeasurement may be defined such that $$z^k_{je}(t_2) = \begin{cases} z_{jk}(t_2) + \hat{u}_{ke}(t_2|t_1) + P_{uke}(t_2|t_1) \\ \text{for time observations} \\ z_{jk}(t_2) + \hat{y}_{ke}(t_2|t_1) + P_{yke}(t_2|t_1) \\ \text{for frequency observations.} \end{cases} \tag{33}$$

This operation translates the actual measurements by a calculable amount that depends on the past ensemble state estimates and the control inputs.

An additional requirement for the use of the usual form of Kalman filters is that the measurement noise, $v_{je}$, is uncorrelated with the plant noise, $\Gamma\vec{s}_{je}$. However, this is not true for the measurement model of Equation 33. Through algebraic manipulations, it has been found that the noise perturbing the pseudomeasurements can be characterized as $$v^k_{je}(t_2) = \begin{cases} v_{jk}(t_2) + [\hat{u}_{ke}(t_2|t_1) + P_{uke}(t_2|t_1) - u_{ke}(t_2)] \\ \text{for time observations} \\ v_{jk}(t_2) + [\hat{y}_{ke}(t_2|t_1) + P_{yke}(t_2|t_1) - y_{ke}(t_2)] \\ \text{for frequency observations.} \end{cases} \tag{34}$$

This pseudonoise depends on the true state at time $t_2$ and is therefore correlated with the plant noise which entered into the evolution of the true state from time $t_1$ to time $t_2$. The correlation of these noises is represented by a matrix C defined by $$C_j^k(t_2) = E[\vec{S}_{je}(t_2|t_1)\vec{V}_{je}^{\,k}(t_2)^T]. \tag{35}$$

For the case of a single time measurement, $\vec{v}$ is a scalar and C is a $4\times 1$ matrix where, $$C_j^k(t_2) = -E\begin{bmatrix} \sum_{i=1}^{N} a_i^2(t_1)\beta'_i(t_2)\beta'_i(t_2) - a_j(t_1)\beta'_j(t_2)\beta'_j(t_2) - a_k(t_1)\beta'_k(t_2)\beta'_k(t_2) \\ \sum_{i=1}^{N} a_i^2(t_1)\epsilon'_i(t_2|t_1)\epsilon'_i(t_2|t_1) - a_j(t_1)\epsilon'_j(t_2|t_1)\epsilon'_j(t_2|t_1) - a_k(t_1)\epsilon'_k(t_2|t_1)\epsilon'_k(t_2|t_1) \\ \sum_{i=1}^{N} a_i(t_1)b_i(t_1)\epsilon'_i(t_2|t_1)\eta'_i(t_2|t_1) - a_j(t_1)\epsilon'_j(t_2|t_1)\eta'_j(t_2|t_1) - b_k(t_1)\epsilon'_k(t_2|t_1)\eta'_k(t_2|t_1) \\ \sum_{i=1}^{N} a_i(t_1)c_i(t_1)\epsilon'_i(t_2|t_1)\alpha'_i(t_2|t_1) - a_j(t_1)\epsilon'_j(t_2|t_1)\alpha'_j(t_2|t_1) - c_k(t_1)\epsilon'_k(t_2|t_1)\alpha'_k(t_2|t_1) \end{bmatrix}. \tag{36}$$

For a single frequency measurement, $$C_j^k(t_2) = -E\begin{bmatrix} \sum_{i=1}^{N} a_i(t_1)b_i(t_1)\epsilon'_i(t_2|t_1)\eta'_i(t_2|t_1) - a_k(t_1)\epsilon'_k(t_2|t_1)\eta'_k(t_2|t_1) - b_j(t_1)\epsilon'_j(t_2|t_1)\eta'_j(t_2|t_1) \\ \sum_{i=1}^{N} b_i^2(t_1)\eta'_i(t_2)\eta'_i(t_2) - a_j(t_1)\eta'_j(t_2)\eta'_j(t_2) - a_k(t_1)\eta'_k(t_2)\eta'_k(t_2) \\ \sum_{i=1}^{N} b_i(t_1)c_i(t_1)\eta'_i(t_2|t_1)\alpha'_i(t_2|t_1) - b_j(t_1)\eta'_j(t_2|t_1)\alpha'_j(t_2|t_1) - c_k(t_1)\eta'_k(t_2|t_1)\alpha'_k(t_2|t_1) \end{bmatrix}.$$

One method of resolving this difficulty is to extend the Kalman filter equations to allow correlated measurement and plant noise.

In this regard, it is possible to have a Kalman recursion with correlated measurement and plant noise. The error in the estimate of the state vector after the measurement at time $t_1$ is $\vec{x}(t_1|t_1)-\vec{x}(t_1)$ and the error covariance matrix is defined to be $$P(t_1|t_1)=E\{[\vec{x}(t_1|t_1)-\vec{x}(t_1)][\vec{x}(t_1|t_1)-\vec{x}(t_1)]^T\} \tag{38}$$

The diagonal elements of this $n \times n$ matrix are the variances of the estimates of the components of $\vec{x}(t_1)$ after the measurement at time $t_1$. The error covariance matrix just prior to the measurement at time $t_2$ is defined as $$P(t_2|t_1)=E\{[\vec{x}(t_2|t_1)-\vec{x}(t_2)][\vec{x}(t_2|t_1)-\vec{x}(t_2)]^T\}. \tag{39}$$

The error covariance matrix evolves according to the system model, such that $$P(t_2|t_1)=\Phi(\delta)P(t_1|t_1)\Phi(\delta)^T+\Gamma Q(t_2|t_1)\Gamma^T. \tag{40}$$

The new estimate of the state vector depends on the previous estimate and the current measurement, $$\begin{aligned} x(t_2|t_2) = \; & \Phi(\delta)x(t_1|t_1) + \Phi(\delta)p(t_1) + \\ & K(t_2)[z(t_2) - H(t_2)\Phi(\delta)x(t_1|t_1) - \\ & H(t_2)\Phi(\delta)p(t_1)] \end{aligned} \tag{41}$$

where the gain matrix, $K(t_2)$, determines how heavily the new measurements are weighted. The desired or Kalman gain, $K_{opt}$, is determined by minimizing the square of the length of the error vector, that is, the sum of the diagonal elements (i.e., the trace) of the error covariance matrix, such that $$\begin{aligned} K_{opt}(t_2) = \; & P(t_2|t_1)H(t_2)^T \times [H(t_2)P(t_2|t)H(t_2)^T + \\ & R(t_2) + H(t_2)C(t_2) + C(t_2)^T H(t_2)^T]^{-1}. \end{aligned} \tag{42}$$

Finally, the updated error covariance matrix is given by $$P(t_2|t_2) = [I - K(t_2)H(t_2)]P(t_2|t_1)[I - K(t_2)H(t_2)]^T + K(t_2)R(t_2)K(t_2)^T - [I - K(t_2)H(t_2)]C(t_2)K(t_2)^T - K(t_2)C^T(t_2)[I - K(t_2)H(t_2)]^T \quad (43)$$

where I is the identity matrix.

Equations 40–43 define the Kalman filter. As defined, the Kalman filter is an optimal estimator in the minimum squared error sense. Each application of the Kalman recursion yields an estimate of the state of the system, which is a function of the elapsed time since the last filter update. Updates may occur at any time. In the absence of observations, the updates are called forecasts. The interval between updates, $\delta = t_2 - t_1$, is arbitrary and is specifically not assumed to be constant. It is possible to process simultaneous measurements either all at once or sequentially. In the present invention, simultaneous measurements are processed sequentially, since sequential processing avoids the need for matrix inversions and is compatible with outlier rejection.

As will be appreciated by those skilled in the art, implementation of the relationships defined in Equations 40–43 as a Kalman filter is a matter of carrying out known techniques.

For the estimation of the reference clock versus the ensemble, the first step is the selection of a reference clock for this purpose. The reference clock referred to herein is distinguished from a hardware reference clock, which is normally used as the initial calculation reference. However, this "software" reference clock normally changes each time the ensemble is calculated for accuracy.

As discussed above, the ensemble consists of N clocks and therefore N estimates of the ensemble time exist. Thus, the first estimate of the ensemble time cannot be rejected and must be robust. To obtain this robust initial estimate, the median of the pseudomeasurements is computed. The clock which yields the median pseudomeasurement is selected as the calculation reference clock, and is designated clock r. In this regard $$z^r_{je} = \text{median}\{z^r_{je}\}_{k=1}^{N} \quad (44)$$

Of the N pseudomeasurements, one pseudomeasurement is a forecast and the remainder of the pseudomeasurements add new information. New pseudomeasurements must be calculated if the reference for the calculation has changed. To change reference clocks from one clock to another, i.e., from clock j to clock r, it is necessary only to form the difference, such that $$Z_{re}^k = Z_{je}^k - Z_{jr} \quad (45)$$

This procedure works even if the initial reference clock (clock r) has been corrupted by some large error.

Once a reference clock has been identified, the plant covariance matrix may be calculated. There are ten independent elements, seven of which are nonzero. These ten elements, which correspond with Equations 13–22, are as follows:

$$E[\beta'_{re}\beta'_{re}] = (1 - a_r)^2 E[\beta'_r\beta'_r] + \sum_{i \neq r} a_i^2 E[\beta'_i\beta'_i] \quad (46)$$

$$E[\epsilon'_{re}\epsilon'_{re}] = (1 - a_r)^2 E[\epsilon'_r\epsilon'_r] + \sum_{i \neq r} a_i^2 E[\epsilon'_i\epsilon'_i] \quad (47)$$

$$E[\eta'_{re}\eta'_{re}] = (1 - b_r)^2 E[\eta'_r\eta'_r] + \sum_{i \neq r} b_i^2 E[\eta'_i\eta'_i] \quad (48)$$

$$E[\alpha'_{re}\alpha'_{re}] = (1 - c_r)^2 E[\alpha'_r\alpha'_r) + \sum_{i \neq r} c_i^2 E[\alpha'_i\alpha'_i] \quad (49)$$

$$E[\beta'_{re}\epsilon'_{re}] = 0 \quad (50)$$

$$E[\beta'_{re}\eta'_{re}] = 0 \quad (51)$$

$$E[\beta'_{re}\alpha'_{re}] = 0 \quad (52)$$

$$E[\epsilon'_{re}\eta'_{re}] = (1 - a_r - b_r)E[\epsilon'_r\eta'_r] + \sum_{i=1}^{N} a_i b_i E[\epsilon'_i\eta'_i] \quad (53)$$

$$E[\epsilon'_{re}\alpha'_{re}] = (1 - a_r - c_r)E[\epsilon'_r\alpha'_r] + \sum_{i=1}^{N} a_i c_i E[\epsilon'_i\alpha'_i] \quad (54)$$

$$E[\eta'_{re}\alpha'_{re}] = (1 - b_r - c_r)E[\eta'_r\alpha'_r] + \sum_{i=1}^{N} b_i c_i E[\eta'_i\alpha'_i] \quad (55)$$

The initial state estimate at time $t_2$ is a forecast via the reference clock r. The initial covariance matrix is the covariance before measurement. The data from all the remaining clocks are used to provide N−1 updates. The pseudomeasurements are processed in order of increasing difference from the current estimate of the time of the reference clock r with respect to the ensemble. Pseudomeasurement I(k) is the "k"th pseudomeasurement processed and I(1) is the reference clock forecast. Outliers (i.e., data outside an anticipated data range) are "de-weighted" when processing pseudomeasurments 2 through N using the statistic $$q_k^2 = \frac{\vec{v}^k_{re}(t_2)\vec{v}^k_{re}(t_2)^T}{E[\vec{v}^k_{re}(\vec{v}^k_{re})^T]}$$

where the $\vec{v}_{re}^k(t_2)$ is the innovation or difference between the pseudomeasurment and the forecast, such that $$\vec{v}_{re}^k(t_2) = \vec{Z}_{re}^k(t_2) - H(t_2)\Phi(t_2|t_1)[\vec{x}(t_1|t_1) + \vec{p}(t_1)]. \quad (56)$$

This equation can be rearranged in the form $$\vec{v}_{re}^k(t_2) = \vec{v}(t_2) - H(t_2)[\vec{x}(t_2|t_1) - \vec{e}(t_2)] \quad (57)$$

After squaring and taking the expectation value, the result is $$E[\vec{v}_{re}^k(\vec{v}_{re}^k)^T] = H(t_2)P(t_2|t_1)H(t_2)^T + R(t_2) + 2H(t_2)\Gamma C_r^k(t_2) \quad (58)$$

To preserve the robustness of the state estimation process, deweighting of the outlier data is used rather than rejection. This preserves the continuity of the state estimates. A nonoptimum Kalman gain is calculated from $$K' = \frac{\psi_{HA}(q)}{q} K_{opt} \tag{59}$$

where $$\psi_{HA}(q) = \begin{cases} q & \text{if } |q| \leqq a \\ \frac{a}{b-a}\left[\frac{bq}{|q|} - q\right] & \text{if } a < |q| \leqq b \\ 0 & \text{if } |q| > b \end{cases} \tag{60}$$

is the Hampel's $\psi$ function.

When this calculation is concluded, the estimates of the states of the reference clock r with respect to the ensemble have been provided. The corresponding estimates for the remaining clocks are obtained by their values with respect to the reference clock r. This procedure is used rather than estimating the clock parameters directly with respect to the ensemble because the innovations of this process are used in parameter estimation.

The estimates of the clocks relative to reference clock r are obtained from N−1 independent Kalman filters of the type described above. The four dimensional state vectors are for the clock states relative to the reference clock r $$\vec{x}_{ri}(t) = \begin{bmatrix} u_{ri}(t) \\ x_{ri}(t) \\ y_{ri}(t) \\ w_{ri}(t) \end{bmatrix}. \tag{61}$$

Every clock pair has the same state transition matrix and $\Gamma$ matrix, which are provided for above in Equations 3 and 5. The system covariance matrices are $Q^{ir}(t+\delta|t)$. The white phase noise is given by the measurement model $$\vec{Z}_{ri} = HX_{ri}\vec{V}_{ri} \tag{62}$$

where each measurement is described by the same 4×1 row matrix $$H_{ri} = (1000) \text{ or } (0010) \tag{63}$$

The updated difference dates are provided in Equation 41, which is one of the equations which define the Kalman filter. No attempt is made to independently detect outliers. Instead, the deweighting factors determined in the reference clock versus ensemble calculation are applied to the Kalman gains in the clock difference filters. The state estimates for the clocks with respect to the ensemble are calculated from the previously estimated states of the reference clock r with respect to the ensemble and the clock difference states, such that $$\vec{x}_{je}(t_2|t_2) - \vec{x}_{re}(t_2|t_2) - \vec{x}_{rj}(t_2|t_2) \tag{64}$$

This essentially completes the calculation of ensemble time. The remaining task is to update all of the parameters used in the computation. The parameter estimation problem is discussed more completely below. Briefly, the parameter estimates are obtained from prediction errors of all possible clock pairs. Accordingly, rather than computing Kalman filters for N−1 clock pairs, the calculations are performed for N(N−1)/2 pairs, ij, for i=1 to N−1 and j=i+1 to N. Certainly, in a large ensemble, this may entail significant computation. But little information is added by comparison of noisy clocks with one another. For each noise type, a list of the five clocks having the lowest noise can be formed. If the index i is restricted to this more limited range, then only 5N−15 filters are required for each parameter estimated.

Next we describe an alternate method of estimating states of the clocks by combining these states into a single state vector and using one Kalman filter.

Kalman Filter Method 2: The ensemble definition can be implemented using the Kalman filter method by combining the states of all the clocks into a single state vector which also explicitly contains the states of the timescale. The clock model is written in matrix form as follows:

$$\vec{x}(t) = \begin{bmatrix} u_1(t) \\ x_1(t) \\ y_1(t) \\ w_1(t) \\ \vdots \\ u_N(t) \\ x_N(t) \\ y_N(t) \\ w_N(t) \\ u_e(t) \\ x_e(t) \\ y_e(t) \\ w_e(t) \end{bmatrix} \tag{64-1}$$

The state vector evolves from time t to time t+δ according to $$\vec{x}(t+\delta) = \Phi(\delta)\vec{x}(t) + \vec{s}(t+\delta) + \Phi(\delta)\vec{p}(t) \tag{64-2}$$

where the 4(N+1)×4(N+1) dimensional state transition matrix $\Phi(\delta)$ embodies the system model described above. The state transition matrix, $\Phi$, depends on the length of the interval, but not on the origin. It consists of N+1 identical 4+4 submatrices, $\Phi$, arranged on the diagonal of a 4(N+1) dimensional matrix that has zeros in all other positions. $\Phi$ is state transition matrix for an individual clock (or clock pair) given in Equation 3.

The 4(N+1) dimensional vector $\vec{s}(t+\delta|t)$ contains the noise inputs to the system during the interval from t to t+δ. Thus, $$\vec{s}(t+\delta|t)=\begin{bmatrix}\beta'_1(t+\delta)+\epsilon'_1(t+\delta|t)\\ \epsilon'_1(t+\delta|t)\\ \eta'_1(t+\delta|t)\\ \alpha'_1(t+\delta|t)\\ \vdots\\ \beta'_N(t+\delta)+\epsilon'_N(t+\delta|t)\\ \epsilon'_N(t+\delta|t)\\ \eta'_N(t+\delta|t)\\ \alpha'_N(t+\delta|t)\\ \beta'_e(t+\delta)+\epsilon'_e(t+\delta|t)\\ \epsilon'_e(t+\delta|t)\\ \eta'_e(t+\delta|t)\\ \alpha'_e(t_\delta|t)\end{bmatrix} \quad (64\text{-}3)$$

Each element of $\vec{s}(t+\delta|t)$ is normally distributed with zero mean and is uncorrelated in time. Finally, the 4(N+1) dimensional vector $\vec{p}(t)$ contains the control inputs made at time t. Equation 64-2 generates a random walk in the elements of the state vector.

A set of r observations, $\vec{z}(t)$ is described by the measurement equation $$\vec{z}(t)=H(t)\vec{x}(t)+\vec{v}(t) \quad (64\text{-}4)$$

which means that the observations made at time t are related linearly to the 4(N+1) elements of the state vector by the r × 4(N+1) dimensional measurement matrix H(t) and the r dimensional white noise vector $\vec{v}(t)$. The noise covariance is defined as:

$$R(t)=E[\vec{v}(t)\vec{v}(t)^T]. \quad (64\text{-}5)$$

For example, the phase measurements of clocks 2 and 3 relative to clock 1 in a three clock ensemble are described by:

$$H(t)=\begin{bmatrix}1000-1000 & 00000000\\ 1000 & 0000-10000000\end{bmatrix}. \quad (64\text{-}6)$$

If the measurements are made simultaneously by a dual mixer measurement system the measurement covariance matrix is:

$$R=\sigma^2_{vx}\begin{bmatrix}2 & 1\\ 1 & 2\end{bmatrix}. \quad (64\text{-}7)$$

where $\sigma^2_{vx}$ is the variance of the phase measurement process. Similarly, the frequency measurements are described by $$H(t)=\begin{bmatrix}001000-1000 & 000000\\ 001000 & 0000-100000\end{bmatrix} \quad (64\text{-}8)$$

The system (or plant) covariance matrix is defined as follows $$Q(t+\delta|t)=E[s(t+\delta|t)s(t+\delta|t)^T] \quad (64\text{-}9)$$

and can be expressed in terms of the spectral densities of the noises of the individual clocks using Equations 13–22.

The Kalman recursion described here is the discrete Kalman filter documented in "Applied Optimal Estimation", A. Gelb, ed., MIT Press, Cambridge, 1974. His derivation assumes that the perturbing noises are white and are normally distributed with mean zero. He further assumes that the measurement noise and the process noise are uncorrelated.

The error in the estimate of the state vector after the measurement at time $t_1$ is $\hat{\vec{x}}(t_1|t_1)-\vec{x}(t_1)$ and the error covariance matrix is defined to be $$P(t_1|t_1)=E\{[\hat{\vec{x}}(t_1|t_1)-\vec{x}(t_1)][\hat{\vec{x}}(t_1|t_1)-\vec{x}(t_1)]^T\}. \quad (64\text{-}10)$$

The diagonal elements of this n × n matrix are the variances of the error in the estimates of the components of $\vec{x}(t_1)$ after the measurement at time $t_1$. Next, the error covariance matrix just prior to the measurement at time $t_2$ is defined as $$P(t_2|t_1)=E\{[\hat{\vec{X}}(t_2|t_1)-\vec{X}(t_2)][\hat{\vec{x}}(t_2|t_1)-\vec{X}(t_2)]^T\}. \quad (64\text{-}11)$$

The error covariance matrix evolves according to the system model.

$$P(t_2|t_1)=\Phi(\delta)P(t_1|t_1)\Phi(\delta)^T+Q(t_2|t_1)$$

The new estimate of the state vector depends on the previous estimate and the current measurement $$\hat{\vec{x}}(t_2|t_2)=\Phi(\delta)\hat{\vec{x}}(t_1|t_1)+\Phi(\delta)\vec{p}(t_1)+ \quad (64\text{-}13)$$
$$K(t_2)[z(t_2)-H(t_2)\Phi(\delta)\hat{\vec{x}}(t_1|t_1)-H(t_2)\Phi(\delta)\vec{p}(t_1)],$$

where the gain matrix, $K(t_2)$, determines how heavily the new measurements are weighted. The optimum or Kalman gain, $K_{opt}$, is determined by minimizing the "square of the length of the error vector,", i.e., the sum of the diagonal elements (the trace) of the error covariance matrix $$K_{opt}(t_2)=P(t_2|t_1)H(t_2)^T[H(t_2)P(t_2|t_1)H(t_2)^T+R(t_2)]^{-1} \quad (64\text{-}14)$$

Finally, the update error covariance matrix is $$P(t_2|t_2)=[I-K(t_2)]H(t_2|t_1)[I-K(t_2)H(t_2)]^T+K(t_2)R(t_2 \quad (64\text{-}15)$$

where $I$ is the identity matrix. Equations 64-12 through 64-15 define the Kalman filter, and so defined it as an optimal estimator in the minimum squared-error sense. Each application of the Kalman recursion yields an estimate of the state of the system, which is a function of the elapsed time since the last filter update. Updates may occur at any time. In the absence of observations, the updates are equal to the forecasts. The interval between updates, $\delta=t_2-t_1$, is arbitrary and is not assumed to be constant over time. It is possible to process simultaneous measurements either all at once or sequentially. Simultaneous processing is used here since it is more compatible than sequential processing with outlier deweighting.

The ensemble definition is used to generate those plant covariance matrix elements that involve ensemble states. It should also be used to connect the individual clock states to the ensemble states. This may be accomplished in an approximate manner by implementing three pseudomeasurements. We rearrange the ensemble definition and replace the forecasts based on the true states by the forecasts based on the prior estimates to obtain $$\sum_{i=1}^{N} a_i(t)u_i(t+\delta) - u_e(t+\delta) \approx \sum_{i=1}^{N} a_i(t)u_i(t+\delta) - u_e(t+\delta) \tag{64-16}$$

$$\sum_{i=1}^{N} a_i(t)y_i(t+\delta) - y_e(t+\delta) \approx \sum_{i=1}^{N} a_i(t)y_i(t+\delta) - y_e(t+\delta) \tag{64-17}$$

$$\sum_{i=1}^{N} a_i(t)w_i(t+\delta) - w_e(t+\delta) \approx \sum_{i=1}^{N} a_i(t)w_i(t+\delta) - w_e(t+\delta) \tag{64-18}$$

The measurements on the left side of these equations are described in the by adding three additional rows.

$$\begin{bmatrix} a_1\,0\,0\;\;0\;\;a_2\,0\,0\;\;0\;\ldots a_N\,0\,0\;\;0\;\;-1\;\;0\;\;0\;\;0 \\ 0\;\;0\,b_1\,0\;\;0\;\;0\,b_2\,0\;\ldots 0\;\;0\,b_N\,0\;\;0\,0\;\;-1\;\;0 \\ 0\;\;0\,0\;\;c_1\,0\;\;0\,0\;\;c_2\ldots 0\;\;0\,0\;\;c_N\;\;0\,0\;\;0\;\;-1 \end{bmatrix} \tag{64-19}$$

The constraint equations may also be implemented using pseudomeasurements. This is particularly simple when the coefficients of the constraint equations are the weights. In that case the pseudomeasurements are:

$$u_e(t+\delta)=0 \tag{64-20}$$

$$y_e(t+\delta)=0 \tag{64-21}$$

$$w_e(t+\delta)=0 \tag{64-22}$$

The measurements on the left side of these equations are also described in the matrix by adding three more rows.

$$\begin{bmatrix} 0\,0\,0\,0\,0\,0\,0\,0\ldots 0\,0\,0\,1\,0\,0\,0 \\ 0\,0\,0\,0\,0\,0\,0\,0\ldots 0\,0\,0\,0\,0\,1\,0 \\ 0\,0\,0\,0\,0\,0\,0\,0\ldots 0\,0\,0\,0\,0\,0\,1 \end{bmatrix} \tag{64-23}$$

Outliers are detected using the method developed by Jones et al., "Estimating Time From Atomic Clocks", NBS Journal of Research, Vol. 80, pp. 17–24, January-February 1983, and are deweighted following the recommendation of Percival, "Use of Robust Statistical Techniques in Time Scale Formation", 2nd Symposium on Atomic Time Scale Algorithms, June, 1982.

The innovation, $\vec{v}(t_2)$, is the difference between the observations and the forecasts, $$\vec{v}(t_2)=\vec{z}(t_2)-H(t_2)\Phi(t_2|t_1)[\hat{\vec{x}}(t_1|t_1)+\vec{p}(t_1)]. \tag{64-24}$$

It has a covariance matrix given by:

$$C=H(t_2)P(t_2|t_1)H(t_2)^T+R(t_2). \tag{54-25}$$

Outliers are not detected by dividing each element of the innovation vector by the corresponding element of the covariance matrix since clock differences are being measured and the elements of the innovation vector are correlated. When there is an error in the reference clock for the measurements, a constant bias will occur in all of the measurements. When there is an error in any other clock, the error will occur in only those measurements involving that clock (usually one). If clock j changes time by an amount $f_j$, then the innovation may be written $$v(t+\delta)=g_jf_j+d, \tag{64-26}$$

where the error vector, $\vec{d}$, has covariance matrix C. The column vector, $\vec{g}_j$, has all ones when clock j is the reference clock. When clock j is not the reference clock, $\vec{g}_j$ has zeros for measurements that don't involve that clock and minus one for any measurement that does. Following Jones, the minimum variance least squares estimate of $f_j$, for a given $\vec{g}_j$, is $$f_j=\frac{g_j^T\;{}^{-1}v}{g_j^T\;{}^{-1}g_j}, \tag{64-27}$$

and has standard error $$s.e.(f_j)=\frac{1}{\sqrt{g_j^T\;{}^{-1}g_j}}, \tag{64-28}$$

If the test statistic, $$q=f_j/s.e.(f_j), \tag{64-29}$$

is large in absolute value, then clock j is assumed to have an error.

Deweighting of erroneous measurements, rather than rejection, of the outlier data is used to enhance the robustness of the state estimation process. Deweighting preserves the continuity of the state estimates. On the other hand, rejecting outliers results in discontinuous state estimates that can destabilize the time-scale computation by causing the rejection of all members of the time-scale. A non-optimum Kalman gain is calculated from $$K'=\frac{\psi_{HA}(q)}{q}K_{opt} \tag{64-30}$$

where $$\psi_{HA}(q)=\begin{cases} q & \text{if } |q| \leqq a \\ \frac{a}{b-a}\left[\frac{bq}{|q|}-q\right] & \text{if } a<|q| \leqq b \\ 0 & \text{if } |q|>b \end{cases} \tag{64-31}$$

is Hampel's $\psi$ function.

Since the reference clock appears in every measurement, it can't be deweighted. Thus, the first step in the outlier deweighting process is to find a good reference clock. Once this is accomplished, all the measurements are processed and deweighting factors are computed for the remaining clocks as necessary.

The outlier detection algorithm of the ensemble calculation identifies the measurements which are unlikely to have originated from one of the processes included in the model. These measurements are candidate time steps. The immediate response to a detected outlier in the primary ensemble Kalman filter is to reduce the Kalman gain toward zero so that the measurement does not unduly influence the state estimates. However, the occurrence of $M_1$ successive outliers is interpreted to be a time step. The time state of the clock that experienced the time step is reset to agree with the last measurement and all other processing continues unmodified. If time steps continue until $M_2$ successive outliers have occurred, as might happen after an extremely large frequency step, then the clock should be reinitialized. The procedure for frequency steps should be used to reinitialize the clock.

Most frequency steps are too small to produce outliers in the primary ensemble Kalman filter. This is because the small frequency steps do not result in the accumulation of large time errors during a single sample interval. Thus, all but the largest frequency steps are detected in secondary ensemble Kalman filters that are computed solely for this purpose. A set of filters with a range of sample intervals will result in the early detection of frequency steps and also produce near optimum sensitivity for a variety of clocks and performances. Recommended sample intervals are one hours, twelve hours, one day, two days, four days, eight days and sixteen days. Since time steps have already been detected (and rejected) using the primary ensemble filter, outliers detected by the secondary filters are considered to have resulted from frequency steps.

When a frequency step is detected in one of the clocks, for example, clock k, it is desirable to reduce the time constant for learning the new frequency. Therefore, a new value is calculated for the spectral density of the random walk frequency noise. First, the estimate of $S_\mu{}^k$ is increased sufficiently so that the detected outlier would have been considered normal. Then, the weights of the clock k are decreased to small values or zero to protect the ensemble. The clock k is then reinitialized using a clock addition procedure.

As discussed previously, the clock weights are positive, semidefinite, and sum to one, without any other restriction. It is possible to calculate a set of weights which minimizes the total noise variance of the ensemble. First, the variance of the noise in the ensemble states is calculated. This is represented by the following equations:

$$E[\beta'e\beta'e] = \sum_{i=1}^{N} a_i^2 E[\beta'_i\beta'_i] \tag{65}$$

$$E[\epsilon'_e\epsilon'_e] = \sum_{i=1}^{N} a_i^2 E[\epsilon'_i\epsilon'_i] \tag{66}$$

$$E[\eta'_e\eta'_e] = \sum_{i=1}^{N} b_i^2 E[\eta'_i\eta'_i] \tag{67}$$

$$E[\alpha'_e\alpha'_e] = \sum_{i=1}^{N} c_i^2 E[\alpha'_i\alpha'_i] \tag{68}$$

The weights which minimize the noise on the states $u_e$, $y_e$, and $w_e$ are obtained by minimizing the appropriate diagonal elements of $\Gamma\vec{s}_e\vec{s}_e{}^T\Gamma^T$, such that $$a_k = \frac{E[\beta'_e\beta'_e] + E[\epsilon'_e\epsilon'_e]}{E[\beta'_k\beta'_k] + E[\epsilon'_k\epsilon'_k]} = \frac{1}{E[\beta'_k\beta'_k] + E[\epsilon'_k\epsilon'_k]}\left[\sum_{i=1}^{N}\frac{1}{E[\beta'_i\beta'_i] + E[\epsilon'_i\epsilon'_i]}\right]^{-1} \tag{69}$$

$$b_k = \frac{E[\eta'_e\eta'_e]}{E[\eta'_k\eta'_k]} = \frac{1}{E[\eta'_k\eta'_k]}\left[\sum_{i=1}^{N}\frac{1}{E[\eta'_i\eta'_i]}\right]^{-1} \tag{70}$$

-continued $$c_k = \frac{E[\alpha'_e\alpha'_e]}{E[\alpha'_k\alpha'_k]} = \frac{1}{E[\alpha'_k\alpha'_k]}\left[\sum_{i=1}^{N}\frac{1}{E[\alpha'_i\alpha'_i]}\right]^{-1} \tag{71}$$

Alternatively, the weights can be chosen to have equal weighting for each member of the ensemble. In this case, $a_k = b_k = c_k = 1/N$.

Minimizing the noise of the time-scale is not necessarily the best approach to clock weighting. The time-scale is realized by following Equation 26-2 and subtracting the estimate of a clock with respect to the time-scale from the actual time of the clock. Thus, the physical realization of the time scale is both perturbed by the time-scale noise and also is in error due to the need to estimate the difference between the time of the clock and the time scale. When the error in this estimation process is dominant, using clock weights that minimize the theorectical noise of the time-scale is not appropriate. It has been found empirically that when the ensemble members differ dramatically in performance, the weights that minimize the time-scale noise do not optimize the overall performance of the physically realized time-scale using Equation 26-2. The situation can be improved by changing the weights associated with the time state and keeping the frequency and frequency aging weights. Thus the weights $$a_k^{**} = \frac{1}{\sqrt{E[\beta'_k\beta'_k] + E[\epsilon'_k\epsilon'_k]}}\left[\sum_{i=1}^{N}\frac{1}{\sqrt{E[\beta'_i\beta'_i] + E[c'_i\epsilon'_i]}}\right]^{-1} \tag{71-1}$$

are used with the optimum b and c weights. This weighting scheme produces optimum long-term performance and slightly suboptimum short-term performance in some circumstances, but is much superior to the time-scale noise minimizing weights when the clocks have very dissimilar performances. The weights of Equation 71-1 are strictly optimum when the clocks have equal performance.

Whatever the method used, the clock weights are chosen in advance of the calculation. However, if there is one or more outliers, the selected weights are modified by the outlier rejection process. The actual weights used can be calculated from $$a_{I(j)} = K'_{I(j)} \prod_{i=j+1}^{N} (1 - K'_{I(i)}) \tag{72}$$

where $K'_{I(1)}$ is defined as 1 and the indexing scheme is as previously described. To preserve the reliability of the ensemble, one usually limits the weights of each of the clocks to some maximum value $a_{max}$. Thus, it may be necessary to readjust the initial weight assignments to achieve the limitation or other requirements. If too few clocks are available, it may not be possible to satisfy operational requirements. Under these conditions, it may be possible to choose not to compute the ensemble time until the requirements can be met. However, if the time must be used, it is always better to compute the ensemble than to use a single member clock.

Another problem to be considered in the Kalman approach is the estimation of the parameters required by a Kalman filter. The techniques that are normally applied are Allan variance analysis and maximum likelihood analysis. However, in using the Allan variance, there is a problem in that the Allan variance is defined for equally spaced data. In an operational scenario, where there are occasional missing data, the gaps may be bridged. But when data are irregularly spaced, a more powerful approach is required.

The maximum likelihood approach determines the parameter set most likely to have resulted in the observations. Equally spaced data are not required, but the data are batch processed. Furthermore, each step of the search for the maximum requires a complete recomputation of the Kalman filter, which results in an extremely time consuming procedure. Both the memory needs and computation time are incompatible with real time or embedded applications.

A variance analysis technique compatible with irregular observations has been developed. The variance of the innovation sequence of the Kalman filter is analyzed to provide estimates of the parameters of the filter. Like the Allan variance analysis, which is performed on the unprocessed measurements, the innovation analysis requires only a limited memory of past data. However, the forecast produced by the Kalman filter allows the computation to be performed at arbitrary intervals once the algebraic form of the innovation variance has been calculated.

The innovation sequence has been used to provide real time parameter estimates for Kalman filters with equal sampling intervals. The conditions for estimating all the parameters of the filter include (1) the system must be observable, (2) the system must be invariant, (3) number of unknown parameters in Q (the system covariance) must be less than the product of the dimension of the state vector and the dimension of the measurement vector, and (4) the filter must be in steady state. This approach was developed for discrete Kalman filters with equal sampling intervals, and without modification, cannot be used for mixed mode filters because of the irregular sampling which prevents the system from ever reaching steady state. However, it is possible to proceed in a similar fashion by calculating the variance of the innovations in terms of the true values of the parameters and the approximate gain and actual covariance of the suboptimal Kalman filter that produces the innovation sequence. We describe two methods of parameter estimation. The first method uses clock time difference estimates, while the second method uses the estimates of the clocks with respect to the ensemble.

Parameter Estimation Method 1: The innovation vector is the difference between the observation and the prediction, as follows:

$$v_{ij}(t_2)=Z_{ij}(t_2)-H^{ij}(t_2)x_{ij}(t_2|t_1) \tag{73}$$

By substituting Equation 73 in the measurement model (Equation 6)

$$E[v(t_2)v(t_2)^T]=H(t_2)P(t_2|t_2)H(t_2)^T R(t_2) \tag{74}$$

since the measurement noise is uncorrolated with system noise for the clock difference filters.

Adaptive modeling begins with an approximate Kalman filter gain K. As the state estimates are computed, the variance of the innovations on the left side of Equation 74 is also computed. The right side of this equation is written in terms of the actual filter element values (covariance matrix elements) and the theoretical parameters. Finally, the equations are inverted to produce improved estimates for the parameters. The method of solving the parameters for discrete Kalman filters with equal sampling intervals is inappropriate here because the autocovariance function is highly correlated from one lag to the next and the efficiency of data utilization is therefore small. Instead, only the autocovariance of the innovations for zero lags, i.e., the covariance of the innovations, is used. The variances are given by $$\begin{aligned} E[v_{ij}(t+\delta)v_{ij}(t+\delta)^T] = \; & P^{ij}_{00}(t|t) + 2\delta P^{ij}_{01}(t|t) + \\ & \delta^2 P^{ij}_{02}(t|t) + \delta^3 P^{ij}_{12}(t|t) + \\ & \delta^2 P^{ij}_{11}(t|t) + \frac{\delta^4}{4} P^{ij}_{22}(t|t) + \\ & S^{ij}_{\xi}(t)\delta + S^{ij}_{\mu}(t)\frac{\delta^3}{3} + \\ & S^{ij}_{\zeta}(t)\frac{\delta^5}{20} + \sigma^2_{vij}(t) + \\ & S^{ij}_{\beta}h \end{aligned} \tag{75}$$

for the case of a time measurement, and $$\begin{aligned} E[v_{ij}(t+\delta)v_{ij}(t+\delta)^T] = \; & P^{ij}_{22}(t|t) + 2\delta P^{ij}_{23}(t|t) + \\ & \delta^2 P^{ij}_{33}(t|t) + S^{ij}_{\mu}(t)\delta + \\ & S^{ij}_{\zeta}(t)\frac{\delta^3}{3} + \sigma^2_{vij}(t) \end{aligned} \tag{76}$$

for the case of a frequency measurement. It is assumed the oscillator model contains no hidden noise processes. This means that each noise in the model is dominant over some region of the Fourier frequency space. The principal of parsimony encourages this approach to modeling. Inspection of Equation 75 leads to the conclusion that each of the parameters dominates the variance of the innovations in a unique region of prediction time interval, $\delta$, making it possible to obtain high quality estimates for each of the parameters through a bootstrapping process. It should be noted that the white phase measurement noise can be separated from the clock noise only by making an independent assessment of the measurement system noise floor.

For each parameter to be estimated, a Kalman filter is computed using a subset of the data chosen to maximize the number of predictions in the interval for which that parameter makes the dominant contribution to the innovations. The filters are designated 0 through 4, starting with zero for the main state estimation filter, which runs as often as possible. Each innovation is used to compute a single-point estimate of the variance of the innovations for the corresponding $\delta$. Substituting the estimated values of the remaining parameters, Equation 75 is solved for the dominant parameter, and the estimate of that parameter is updated in an exponential filter of the appropriate length, for example, $$\sigma^2_{v_{ij}}(t+\delta) + S^{ij}_{\beta}(t+\delta)h \approx v_{ij}(t+\delta)v_{ij}(t+\delta)^T - P^{ij}_{00}(t|t) - 2\delta P^{ij}_{01}(t|t) - \delta^2 P^{ij}_{02}(t|t) - \delta^3 P^{ij}_{12}(t|t) - \delta^2 P^{ij}_{11}(t|t) - \frac{\delta^4}{4} P^{ij}_{22}(t|t) - S^{ij}_{\xi}(t)\delta - S^{ij}_{\mu}(t)\frac{\delta^3}{3} - S^{ij}_{\zeta}(t)\frac{\delta}{2} \quad (77)$$

If the minimum sampling interval is too long, it may not be possible to estimate one or more of the parameters. However, there is no deleterious consequence of the situation, since a parameter that cannot be estimated is not contributing appreciably to the prediction errors. Simulation testing has shown that the previously described method combines good data efficiency and high accuracy.

Each time a clock pair filter runs, a single estimate is obtained for one of the noise spectral densities or variances of the clock, represented by $F^{ij}$. A Kalman filter can be used to obtain an optimum estimate for all $F^i$, given all possible measurements $F^{ij}$. The $F^i$ for a given noise type are formed into an N dimensional vector $$F(t) = \begin{bmatrix} F^1(t) \\ F^2(t) \\ \cdot \\ \cdot \\ \cdot \\ F^N(t) \end{bmatrix}. \quad (78)$$

The state transition matrix is just the N dimensional identity matrix. The noise vector is chosen to be non-zero in order to allow the estimates to change slowly with time. This does not mean that the clock noises actually experience random walk behavior, only that this is the simplest model that does not permanently lock in fixed values for the noises. The variances of the noises perturbing the clock parameters can be chosen based on the desired time constant of the Kalman filter. Assuming that the noise is small, the Kalman gain is approximately $\sigma_F/\sigma_{meas}$. The parameter value will refresh every M measurements when its variance is set to $1/M^2$ of the variance of the single measurement estimate of the parameter. A reasonable value for the variance of a single measurement is $\sigma_{meas}^2$ being approximately equal to $2F^i$. The measurement matrix for the "i"th measurement is a $1 \times N$ row vector whose "i"th and "j"th elements are unity and whose remaining elements are zero, such that $H^{ij} = [0 \ldots 010 \ldots 010 \ldots 0]$. All the individual clock parameters are updated each cycle of the Kalman recursion, even though the measurement involves only two clocks, because the prior state estimates depend on the separation of variances involving all of the clocks.

The storage requirements for this approach are minimal. There are five N element state vectors, one for each of the possible noise types (white phase noise, white frequency noise, white frequency measurement noise, random walk frequency noise, and random walk frequency noise aging). There are also five $N \times N$ covariance matrixes. A total of 5 $N(N-1)/2$ cycles of the Kalman recursion are currently believed necessary for the parameter update.

Parameter Estimation Method 2: A variance analysis technique compatible with irregular observations has been developed. The variance of the innovation sequence of the time-scale calculation is analyzed to provide estimates of the parameters of the filter. Like the Allan variance analysis, which is performed on unprocessed measurements, the innovation analysis requires only limited memory of past data. However, the forecasts allow the computation to be performed at arbitrary intervals once the algebraic form of the innovation variance has been calculated.

The innovation, $\vec{v}(t_2)$, is calculated from Equation 64-24. This equation can be rearranged in the form $$\vec{v}(t_2) = \vec{z}(t_2) - H(t_2)[\vec{x}(t_2|t_1) - \vec{x}(t_2)]. \quad (64\text{-}32)$$

After squaring and taking the expectation value one finds $$E[vv^T - H(t_2)P(t_2|t_1)H(t_2)^T + R(t_2). \quad (64\text{-}33)$$

Consider a Kalman filter to compute the estimates of $\vec{x}_j$. Suppose the measurements for this filter are the $\hat{u}_j$ that were computed during the time-scale computation. Such a filter has $R = 0$. Examination of Eq. 20 leads to the conclusion that $$E[\vec{v}_j\vec{v}_j^T] = H(t_2|t_1)H(t_2)^T. \quad (64\text{-}34)$$

Evaluation of the terms on the right hand side leads to the equation $$E[\vec{v}(t+\delta)\vec{v}(t+\delta)^T] = [\Phi(t+\delta|t)P^j(t|t)\Phi(t+\delta|t)^T]_{00} + S_{\xi}^j(t)\delta + S_{\zeta}^j(t)\frac{\delta^3}{3} + S_{\zeta}^j(t)\frac{\delta^5}{20} + \sigma^2_{v_j}(t) + S^j_{\beta}\cdot h \quad (64\text{-}35)$$

Each cycle of the filter is used to compute a primitive estimate of the variance of the innovations, where the innovation is a scalar equal to $\hat{u}_j(t+\delta|t+\delta) - \hat{u}_j(t+\delta|t)$.

$$S_{\xi}^j(t+\delta)\delta + S_{\mu}^j(t+\delta)\frac{\delta^3}{3} + S_{\zeta}^j(t+\delta)\frac{\delta^5}{20} + \sigma^2_{v_{je}}(t+\delta) + S^j_{\beta}\cdot h \approx v_{je}(t+\delta)v_{je}(t+\delta)^T - [\Phi(t+\delta|t)P^j(t|t)\Phi(t+\delta|t)^T]_{00} \quad (64\text{-}36)$$

where $$[\Phi(t+\delta|t)P^j(t|t)\Phi(t+\delta|t)^T]_{00} = P^j_{00}(t|t) + 2\delta P^j_{01}(t|t) + \delta^2 P^j_{02}(t|t) + \delta^3 P^j_{12}(t|t) + \delta^2 P^j_{11}(t|t) + \frac{\delta^4}{4} P^j_{22}(t|t) \quad (64\text{-}37)$$

The spectral densities are calculated based on the assumption that the oscillator model contains no hidden noise processes. This means that each noise in the model is dominant over some region of Fourier frequency space. The principle of parsimony encourages this approach to modeling. Inspection of Equation 64-37 leads to the conclusion that each of the parameters dominates the variance of the innovations in a unique region of prediction time interval, $\delta$, making it possible to obtain high-quality estimates for each of the parameters through a bootstrapping process. Note that the white phase measurement noise can be separated from the clock noise only by making an independent assessment of the measurement system noise floor.

For each parameter to be estimated, a Kalman filter is computed using a subset of the data chosen to maximize the number of predictions in the interval for which that parameter makes the dominant contribution to the innovations. Five filters should be sufficient to estimate parameters in a time-scale of standard and high performance cesium clocks, active hydrogen masers, and mercury ion frequency standards. The filters are designated 1 through 5, starting with 1 for the main state estimation filter. Each innovation is used to compute a single-point estimate of the variance of the innovations for the corresponding $\delta$. Substituting the estimated values of the remaining parameters, Eq. 24 is solved for the dominant parameter, and the estimate of that parameter is updated in an exponential filter of the appropriate length. If the minimum sampling interval is too long, it may not be possible to estimate one or more of the parameters. However, there is no deleterious consequence of this situation, since a parameter that cannot be estimated is not contributing appreciably to the prediction errors. Simulation testing in the case of a single clock has shown that the previously described method combines good data efficiency and high accuracy. The following is an example of an appropriate procedure. The measurement noise is assumed to lie between $\sigma_y(1s)=1\times10^{-12}$ and $1\times10^{-11}$.

FILTER 1 Runs at a nominal sampling rate of 300 seconds. Such fast data acquisition is important for real-time control. It is also fast enough to permit the estimation of the white phase noise for active hydrogen masers. The source of this noise is the measurement system. The same level of white phase noise should be assigned to all time measurement channels. No other parameters should be estimated using this filter. To determine whether the white phase noise may be measured for a given clock, verify that $S_\beta'h>S_\xi\delta$.

FILTER 2 Runs at a nominal sampling rate of 3 hours. This sampling rate is appropriate for estimating the white frequency noise of all the clocks including the mercury ion devices. To determine whether the white frequency noise may be estimated for a given clock, verify that $S_\beta'h<S_\xi\delta$ and $S_\xi\delta>S_\mu\delta^3/3$. Frequency steps may be detected.

FILTER 3 Runs at a nominal sampling rate of 1 day. This sampling rate is appropriate for estimating the random walk frequency noise for active hydrogen masers. To determine whether the random walk frequency noise may be estimated for a given clock, verify that $S_\xi\delta<S_\mu\delta^3/3$ and $S_\mu\delta^3/3>S_\zeta\delta^5/20$. Frequency steps may be detected.

FILTER 4 Runs at a nominal sampling rate of 4 days. To determine whether the random walk frequency noise may be estimated for a given clock, verify that $S_\xi\delta<S_\mu\delta^3/3$ and $S_\mu\delta^3/3>S_\zeta\delta^5/20$. Frequency steps may be detected.

FILTER 5 Runs at a nominal sampling rate of 16 days. To determine whether the random walk frequency noise may be estimated for a given clock, verify that $S_\xi\delta<S_\mu\delta^3$ and $S_\mu\delta^3/3>S_\zeta\delta^5/20$. Frequency steps may be detected.

An implementation of the present invention will now be described with respect to FIG. 1. FIG. 1 illustrates a circuit for obtaining a computation of ensemble time from an ensemble of clocks 10. The ensemble 10 includes N clocks 12. The clocks 12 can be any combination of clocks suitable for use with precision time measurement systems. Such clocks may include, but are not limited to cesium clocks, rubidium clocks, hydrogen maser clocks and quartz crystal oscillators. Additionally, there is no limit on the number of clocks.

Each of the N clocks 12 produces a respective signal $\mu_1, \mu_2, \mu_3, \ldots, \mu_N$ which is representative of its respective frequency output. The respective frequency signals are passed through a passive power divider circuit 14 to make them available for use by a time measurement system 16, which obtains the time differences between designated ones of the clocks 12. As discussed above, the desired time differences are the differences between the one of the clocks 12 designated as a hardware reference clock and the remaining clocks 12. The clock 12 which acts as the reference clock can be advantageously changed as desired by an operator. For example, if clock 12 designated "clock 1" is chosen to be the reference clock, the time measurement system 16 determines the differences between the reference clock and the remaining clocks, which are represented by $z_{12}, z_{13}, z_{14}, \ldots {}_{1N}$. These data are input to a computer 18 for processing in accordance with the features of the present invention as described above, namely, the complete ensemble definition as provided above. When the ensemble definition as provided by Equations 23-25 is provided for in Kalman filters, and since the Kalman filters are software-implemented, the Kalman filters can be stored in memory 20. The computer 18 accesses the memory 20 for the necessary filters as required by the system programming in order to carry out the time scale computation. The weights and other required outside data are input by operator through a terminal 22. Upon completion of the processing of the clock data via the Kalman filters according to the present invention, an estimate of the ensemble time is output from the computer 20 to be manipulated in accordance with the requirements of the user.

As discussed above, Kalman filters have been previously used in connection with ensembles to obtain ensemble time estimates. These Kalman filters embodied the previous incomplete ensemble definitions in Kalman form for the appropriate processing. Accordingly, it will be appreciated by those skilled in the art that the actual implementation of the Kalman equations into a time measurement system as described above and the appropriate programming for the system are procedures known in the art. As also should be appreciated, by providing a complete definition of the ensemble, the present system generally provides a superior calculation of the ensemble time with respect to prior art.

While one embodiment of the invention has been discussed, it will be appreciated by those skilled in the art that various modifications and variations are possible without departing from the spirit and scope of the invention.

What is claimed is:

1. A system for providing an ensemble time comprising:

a plurality of clocks, each of said plurality of clocks providing a clock signal;

first means for measuring differences between clock signal related parameters for pairs of clocks of said plurality of clocks; and second means, which uses said differences, for providing a first ensemble time, said second means including means for implementing an ensemble time definition that has a plurality of solutions which are representative of an ensemble time and means for constraining said plurality of solutions to a number of solutions that is less than said first plurality of solutions.

2. A system, as claimed in claim 1, wherein:

said second means includes means for providing an estimate of the state of each clock of said plurality of clocks and means for causing the variance of the estimate of the state of each clock of said plurality of clocks to be substantially equal to the true variance of the time states.

3. A system, as claimed in claim 1, wherein:

said second means includes means for providing an estimate of the state of each clock of said plurality of clocks and means for weighting the estimate of the state of each clock of said plurality of clocks that is proportional to the rms noise of the state of each said clock.

4. A system, as claimed in claim 1, wherein:

said second means includes means for providing an estimate of the state of each clock of said plurality of clocks, means for weighting the estimates of the state of each clock of said plurality of clocks to obtain better estimates of the true states of said plurality of clocks, said means for weighting includes a first set of weights, and said means for constraining includes a second set of weights that is different than said first set of weights to improve robustness of said first ensemble time.

5. A system, as claimed in claim 1, wherein:

said second means includes means for providing a substantially unbiased estimate of the spectral density of each clock of said plurality of clocks.

6. A system, as claimed in claim 1, wherein:

said first ensemble time has a first sampling interval and substantially optimal performance over a first range of sampling intervals;

said second means includes means for providing a second ensemble time has a second sampling interval that is different than said first sampling interval and substantially optimal performance over a second range of sampling intervals and means for combining said first ensemble time and said second ensemble time to provide a third ensemble time that has substantially optimal over a third range of sampling intervals that is greater than said first and second sampling intervals.

7. A system, as claimed in claim 6, wherein:

said means for combining includes means for phase-locking said first ensemble time and said second ensemble time.

8. A system, as claimed in claim 6, wherein:

said means for combining includes a second-order phase-locked loop for use in combining said first ensemble time and said second ensemble time.

* * * * *